United States Patent [19]

Grubb

[11] 4,194,276

[45] Mar. 25, 1980

[54] CONNECTOR HOLDING FIXTURE

[75] Inventor: Daniel B. Grubb, Hummelstown, Pa.

[73] Assignee: AMP Incorporated, Harrisburg, Pa.

[21] Appl. No.: 969,503

[22] Filed: Dec. 14, 1978

[51] Int. Cl.[2] ..... H01R 43/00

[52] U.S. Cl. ..... 29/56.6; 29/566.3; 29/749; 269/321 WE

[58] Field of Search ..... 29/56.6, 33 M, 566.3, 29/749, 566.1, 750, 751; 269/321 WE

[56] References Cited

U.S. PATENT DOCUMENTS

| | | | |
|---|---|---|---|
| 3,816,897 | 6/1974 | Long | 29/56.6 |
| 3,845,535 | 11/1974 | Over | 29/749 X |
| 3,886,641 | 6/1975 | Davis | 29/56.6 |
| 4,035,897 | 7/1977 | Over et al. | 29/56.6 |
| 4,085,497 | 4/1978 | Nijman et al. | 29/749 X |
| 4,091,530 | 5/1978 | Nijman et al. | 29/749 |
| 4,091,531 | 5/1978 | Grubb et al. | 29/749 |
| 4,125,137 | 11/1978 | Shatio, Jr. | 29/749 |

*Primary Examiner*—William R. Briggs
*Attorney, Agent, or Firm*—Frederick W. Raring

[57] ABSTRACT

Fixture for supporting an electrical connector and positioning wires in spaced relationship to the connector in preparation for insertion of the wires into the connector comprises a channel-shaped frame member having a web and sidewalls. The external surface of the web serves as a supporting surface for the mating end of the connector. First and second connector clamping means are mounted against the external surfaces of the sidewalls of the frame and clamp the connector in a predetermined position. The clamping means extend above the external surface of the web and have aligned wire positioning slots in their free ends which position the wires in alignment with the connector. The fixture is intended for use with a tool which can be latched to the fixture and which, upon actuation, trims the wires and inserts them into the connector.

10 Claims, 6 Drawing Figures

CONNECTOR HOLDING FIXTURE

DESCRIPTION

1. Field of the Invention

This invention relates to fixtures of the type used in harness manufacturing operations or similar operations and which support a connector and wires during manufacture of the harness. Known fixtures of the general class to which the invention relates are shown in U.S. Pat. Nos. 3,845,535 and 4,035,897.

2. Background of the Invention

U.S. Pat. No. 3,845,535 discloses a harness making apparatus comprising a plurality of fixtures mounted on a harness board which hold connectors at locations corresponding to the desired locations of connectors in the harness being manufactured. Each fixture has wire-receiving slots therein so that the wires of the harness can be laced over the harness board and placed in the several fixtures with the wires extending along paths corresponding to the desired wiring plan of the harness. The connectors are of the type which are adapted to receive wires upon movement of the wires laterally of their axes and into wire-receiving portions of terminals in the connectors. A portable wire trimming and insertion tool is provided which is adapted to be removably mounted on each fixture in turn and actuated while it is on each fixture to trim the wires and insert them into the connector.

The harness making method and apparatus as generally disclosed in U.S. Pat. No. 3,845,535 is coming into widespread use in the electrical industry with several different types of connectors. As a result, there has arisen a need for an improved fixture which can be produced at reduced cost and which is capable of accepting different types of electrical connectors and connectors having varying numbers of contact terminals therein. For example, connectors of the types shown in applications having Ser. Nos. 934,914 filed Aug. 18, 1978, 895,556 filed Feb. 12, 1978 and 859,067 filed Dec. 9, 1977 are being used to an increasing extent and it would be desirable to have a fixture capable of accepting all of these types of connectors and being able to accept connectors of varying sizes. The present invention is directed to the achievement of a fixture satisfying these and other requirements.

A fixture in accordance with the present invention comprises a channel-shaped frame member having a web, sidewalls, and having laterally extending flanges on the ends of the sidewalls. First and second clamping assemblies are mounted on the frame member and against the external surfaces of the sidewalls, these clamping assemblies having means for positioning one or more connectors on the external surface of the web of the frame. The clamping assemblies further have aligned wire-admitting slots therein so that the wires which are to be connected to the terminals in the connector can be located precisely in alignment with the terminals.

Fixtures in accordance with the invention are employed in harness manufacturing operations by positioning a plurality of fixtures on a harness board with each fixture being located at a position corresponding to the desired position of a connector in the harness being manufactured. The wires required for the harnesses are laced over the harness board between and among the various fixtures and are positioned in the fixtures in alignment with terminals in the connectors supported in the fixtures. After the completion of the wire lacing operation, a portable wire insertion tool is latched to each of the fixtures in turn and actuated to move the wires from the fixture into the wire-receiving portions of the terminals in the connector. After insertion of the wires, the completed harness can be removed from the harness board.

PRACTICE OF THE INVENTION

Figure 1:
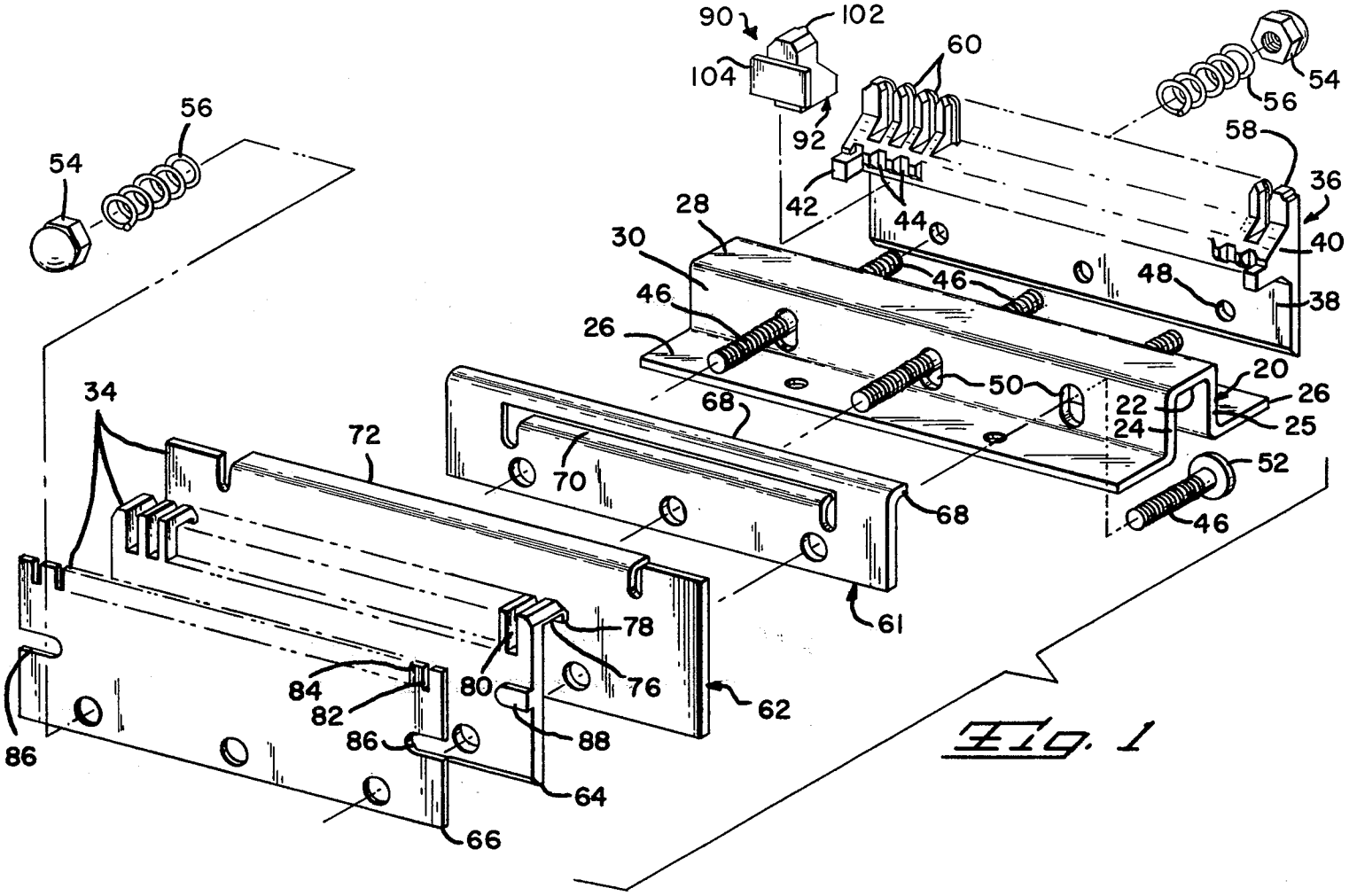
FIG. 1 is a perspective view of the parts of a fixture in accordance with the invention exploded from each other.

A fixture 2 in accordance with the invention is commonly used on a harness board 4 (FIG. 4) and is adapted to receive one or more connectors of the type shown at 6, 8, 10 (FIG. 5) during manufacture of an electrical harness 16. The wires 12 are inserted into the terminals while the connector is held in the fixture by means of an insertion tool 14 which is described below.

The fixture 2 comprises a channel-like frame member 20 having a web 22, sidewalls 24, 25, and flanges 26 which extend from the ends of the sidewalls. The web 22 has an external surface 28 which serves as a support surface for the mating end of a connector and the sidewalls 24, 25 have external surfaces 30, 32.

Figure 2:
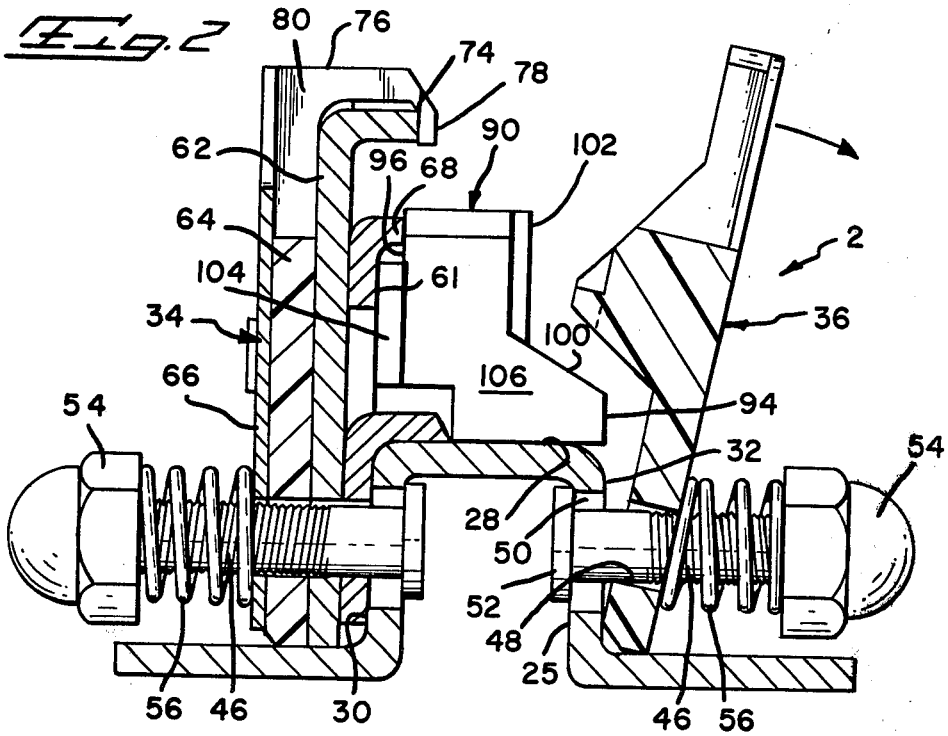
FIG. 2 is a sectional side view of the fixture.
Figure 3:
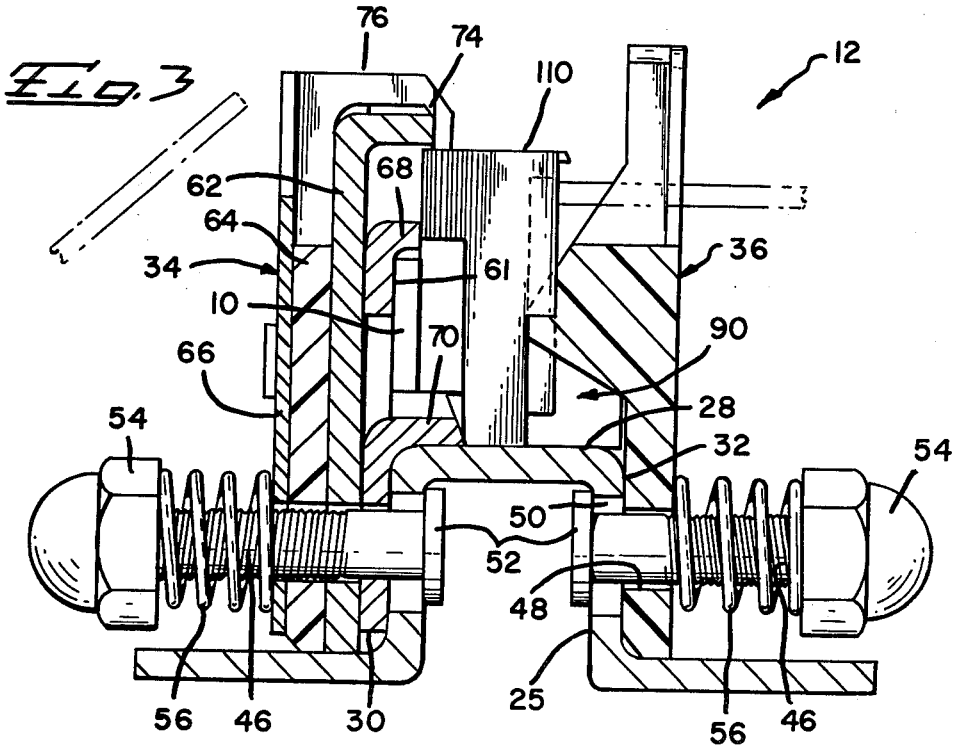
FIG. 3 is a view similar to FIG. 2 but showing a connector positioned in the fixture.

First and second connector clamping means 34, 36 are mounted on the frame against the external surfaces of the sidewalls as shown in FIG. 2 and extend beyond the external surface 28 of the web so that a pocket is formed between these clamping means which receives one or more of the connectors 6, 8, 10.

The second clamping means 36 which is against the external sidewall 32 may be of molded plastic and comprises a generally rectangular plate 38 having a triangular rib 40 extending across the upper portion of its surface which is against the sidewall 32. Arms 42 extend forwardly beyond the apex of this rib at the ends of this plate-like member 38 and serve to confine the connector or connectors mounted in the fixture. The apex of the rib 40 is provided with spaced-apart notches 44 which receive ribs 116 on the connectors, as will be described below, so that the connectors will be precisely located in the fixture with respect to wire-receiving slots 60, 80 in the clamping means 34, 36.

The clamping plate 36 is resiliently held against the external surface 32 of the sidewall 25 by a clamping bolt 46 having a shank portion which extends through a circular opening 48 in the clamping member 36, through an oversized opening 50 in the sidewall 25, and which has an enlarged head 52 on its end, the diameter of this head being greater than the width of the opening 50. The shank of the bolt extends rightwardly as viewed in FIG. 2 beyond the clamping member 36 and has a nut 54 threaded on its end, a spring 56 being interposed between this nut and the surface of the clamping plate. It will be apparent that by virtue of the oval-shaped opening 50 in the sidewall 25, the clamping plate 36 can be swung along an arcuate path in a clockwise direction from the position shown in FIG. 2 to permit placement of a connector in, and removal from, the fixture. The upper free end 58 of the clamping plate 36 is provided with spaced-apart wire positioning slots 60 which receive portions of the wires 12 as will be described below.

The connector clamping means 34 on the left as viewed in FIG. 2 comprises a connector positioning plate 61, a shearing plate 62, a wire locating plate 64, and a wire clamping or holding plate 66, these plates being stacked against each other as shown in FIG. 2 and held against the external surface of sidewall 24 by a clamping bolt 46 of the type previously described.

The connector clamping plate 61 comprises a generally flat rectangular plate having an inwardly directed lip 68 extending from its upper edge which bears against an offset portion of a connector 6 positioned in the fixture and a lower inwardly directed lip 70 which extends over the surface 28 of web 22 and which bears against the connector adjacent to its mating end 108.

The shearing plate 62 comprises a simple flat plate having an inwardly directed lip 72 at its upper edge which extends towards and slightly past a connector positioned in the fixture. The edge 74 of this lip serves as a shearing edge for cooperation with movable shearing edges in the tool 14 as generally described in the above identified U.S. Pat. No. 3,845,535 and as will be discussed below.

The wire positioning plate 64 which may be of firm plastic has an inwardly directed flange 76 at its upper end which extends over the lip 72 and which has a depending end portion 78 which extends to the wire receiving end 110 of a connector held in the fixture. Spaced-apart wire positioning slots 80 are provided in the flange 76, in the depending end portion 78 thereof, and extend downwardly as shown in FIG. 2 in this member. These wire positioning slots are in alignment with the wire-positioning slots 60 in the clamping member 36 and in alignment with narrow wire clamping slots 82 in the wire clamping plate 66. The clamping plate 66 is of relatively thin sheet metal and the slots 82 which extend downwardly from its upper edge 84 are relatively narrow so that when a wire is positioned in aligned slots 60 and 80 and is pulled into a slot 82, it will be pinched and held in the slot 82.

The clamping plate 66 is provided with notches 86 at its end which receive bosses 88 on the adjacent surface of the wire positioning member 64 to insure that the slots 82 will be in precise alignment with the slots 80.

Figures 5, 6:
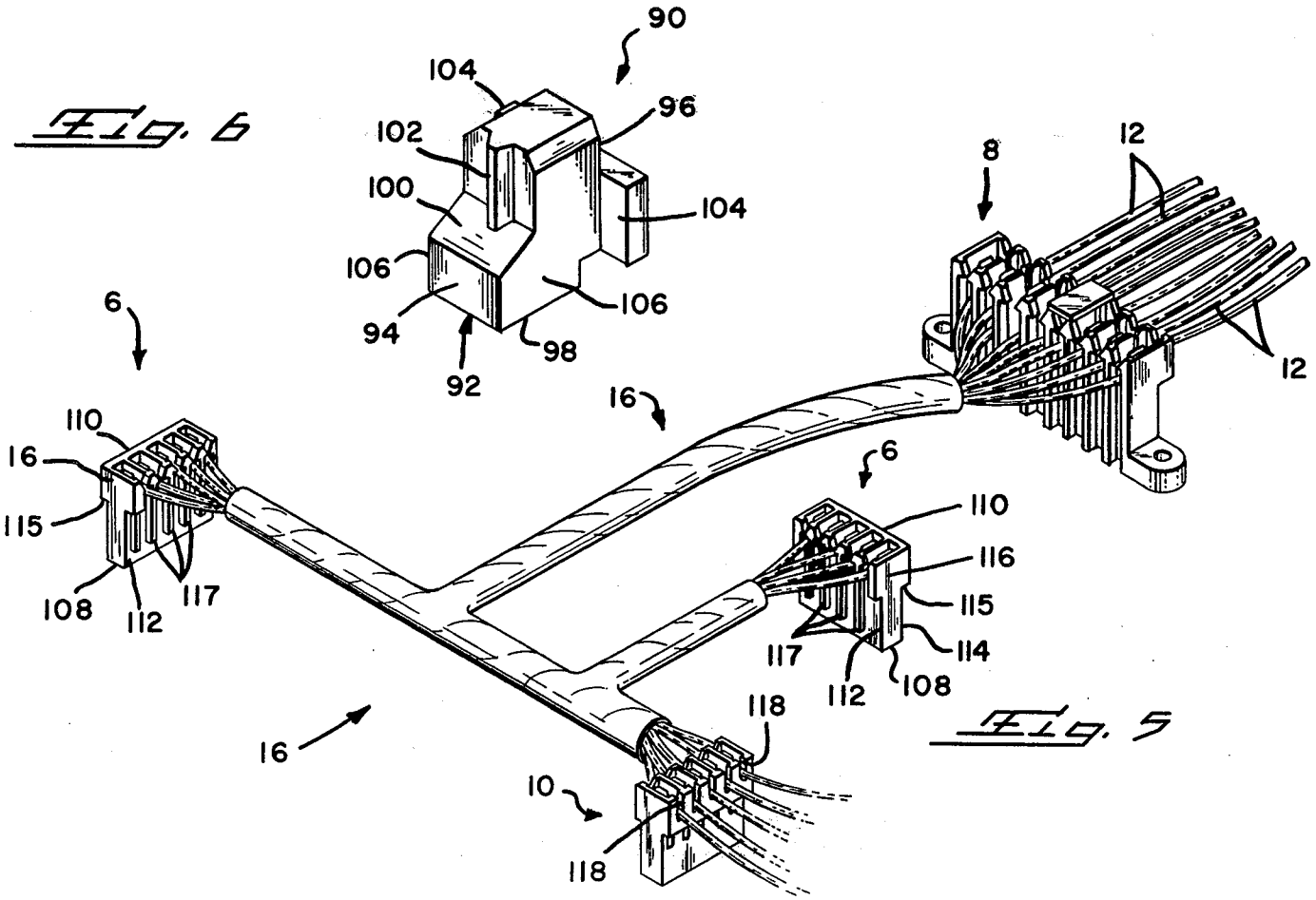
FIG. 5 is a fragmentary view of a portion of a finished harness.
FIG. 6 is a view of a selectively positionable locating stop used with fixture.

As will be apparent from an inspection of FIG. 5, connectors of the types shown at 6, 8, 10 have varying numbers of wire positions therein. In a harness making operation, it will usually be necessary or desirable to locate a connector in the fixture in a precisely predetermined position between the arms 42. To facilitate precise positioning of a connector, or more than one connector, in the fixture, selectively positionable stops 90 are provided which can be located accurately on the external surface 28 of the web. Each stop comprises a block 92 having sides 94, 96 which are opposite to the clamping assemblies 36, 34 respectively, when the stop is mounted in the fixture with the bottom surface 98 of the stop on surface 28. The side 94 is, therefore, inclined as shown at 100 to provide clearance for the rib 40 of the clamping member 36 and a rib 102 is provided in the upper surface of this side which is dimensioned to be received in one of the notches 44. The side 96 bears at its upper end against the lip 68 of the plate 61 and arms 104 extend laterally from this side to provide bearing surface for the stop against the plate 61. It will be apparent that a pair of stops 90 can be positioned in the socket between the clamping members 34, 36 such that the connector can be positioned between these stops with the endwalls of the connector against the opposed endwalls 106 of the positioning stops. The stops can be permanently or semi-permanently positioned on the surface 28 with a suitable adhesive.

The three types of connectors shown in FIGS. 5, 6, 8, 10 have the same profile so that they can all be positioned in the fixture. The connector 6 comprises an insulating housing having a mating end 108, a wire-receiving end 110, sidewalls 112, 114 and endwalls 116. The sidewall 114 has an offset portion adjacent to the wire-receiving end 110 as shown at 115. Wire-receiving slots extend downwardly as viewed in FIG. 5 from the wire-receiving end in the sidewall 112 and adjacent slots are separated by ribs 117. These ribs are received in the notches 44 of the clamping member 36 as previously noted.

The connector 10 is generally similar to the connector 6 excepting that it has slots 118 in the offset upper portion 115 of the sidewall 114 so that intermediate portions of wires can be connected to the terminals in this connector as shown in FIG. 5. The connector 8 is also generally similar in external appearance to the connector 6 but is of the type shown and described in application Ser. No. 895,556 and is used to connect conductors 12 to each other rather than to a mating connector.

Figure 4:
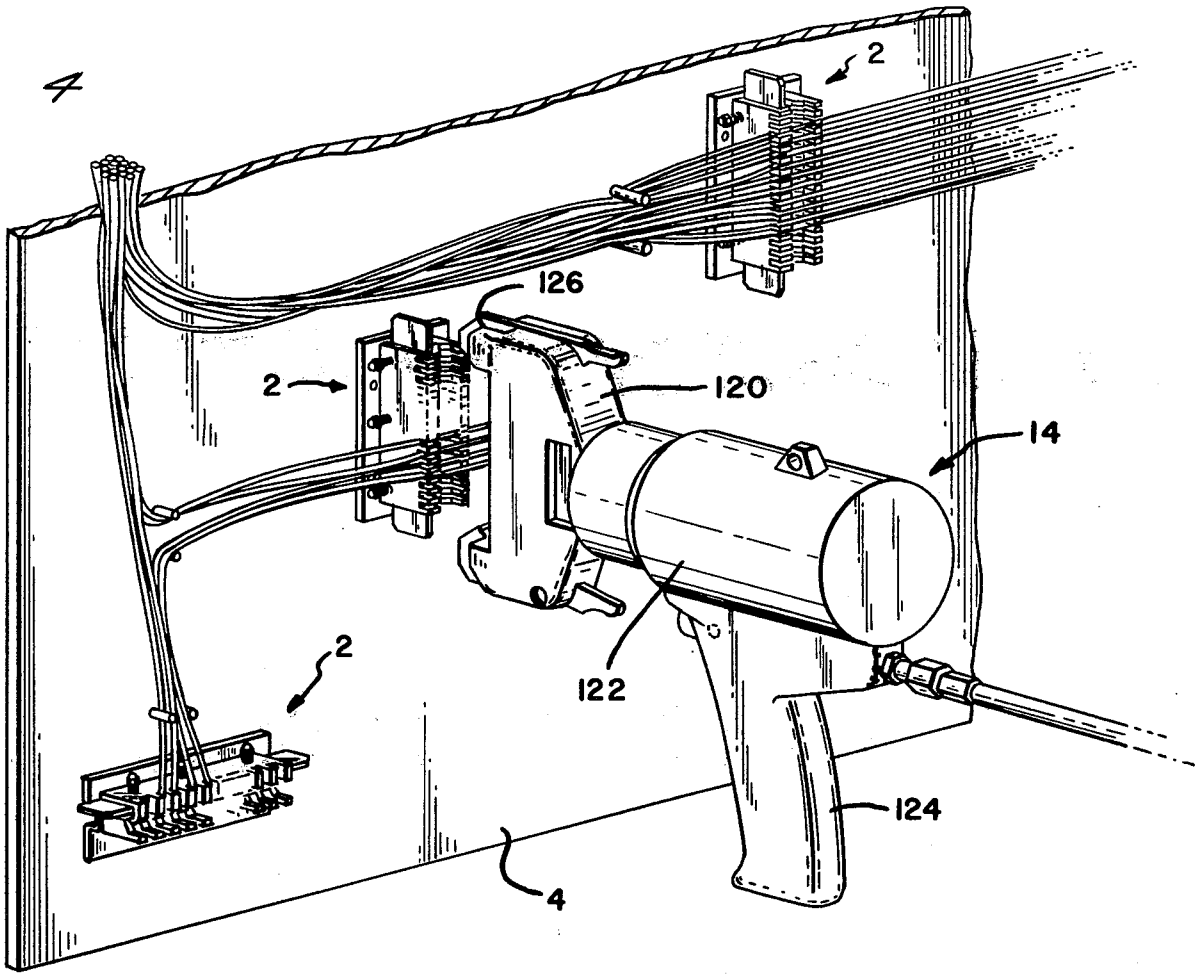
FIG. 4 is a fragmentary perspective view of a portion of a harness board having fixtures mounted on its surface and illustrating the manufacture of an electrical harness.

In use, fixture 2 will ordinarily be mounted on a harness board 4 as shown at FIG. 4 and the required connectors 6, 8, and 10 will be placed in the fixtures. Each fixture may have only one connector positioned therein or it may have more than one connector as previously explained. The wires 12 are laced over the harness board between and among the fixtures and are positioned in the aligned slots 60, 80, 82 of the fixtures as shown in FIG. 4. After lacing of the wires, the wires are trimmed where appropriate and inserted into the terminals in the connectors by means of a tool 14 which comprises a tool head 120 having an insertion ram therein which, upon actuation, inserts the wires into the connector. The tool is latched to the ends of the frame 20 of each of the fixtures in turn by latch arms 126 and the insertion ram is actuated by a piston cylinder 122. The tool disclosed has a pistol grip handle 124 so that it can be conveniently carried over the harness board and latched in turn to the fixtures.

I claim:

1. A fixture for supporting an electrical connector in a predetermined position and for locating conductors in spaced relationship to the conductor-receiving portions of terminals in said connector preparatory to the insertion of said conductors into said conductor-receiving portions, said fixture comprising:

a channel-shaped frame member having a web and sidewalls, said web having an external surface which constitutes a connector supporting surface, first and second connector clamping means, each of said clamping means being against the external surface of one of said sidewalls, said clamping means extending past said external surface of said web whereby a connector-receiving pocket is formed by said external surface of said web and said clamping means, each of said clamping means having free end portions which are spaced from said web, at least one of said clamping means being resiliently held against its respective sidewall and being movable away therefrom to permit placement of said connector in said pocket, conductor locating means in said free end portions of said connector clamping means for locating said conductors in said free ends with portions of said conductors extending across said pocket, connector locating means for locating said connector on said connector supporting surface with said conductor-receiving portions of said terminals in alignment with conductors in said conductor locating means, said connector locating means comprising spaced-apart projections on one of said clamping means which are received in spaced-apart recesses in said connector, said projections being spaced-apart by distances which are the same as the spacing between said conductor-receiving portions of said terminals in said connector, whereby, upon placement of said connector in said pocket and on said supporting surface, and placement of said conductors in said conductor locating means, said conductors can be moved laterally of their axes and into said conductor-receiving portions of said terminals.

2. A fixture as set forth in claim 1, said second clamping means comprising a plate-like member, said connector locating means comprising a rib extending across said member, said rib having spaced-apart notches therein, portions of said rib between said notches constituting said projections.

3. A fixture as set forth in claim 2, said first clamping means comprising a clamping plate having laterally extending clamping lips which extend into said pocket, one of said lips extending across, and adjacent to, said connector supporting surface and the other of said lips being spaced from said connector supporting surface, said lips being engageable with said connector whereby said connector is clamped between said lips and said projections on said second clamping means.

4. A fixture as set forth in claim 3, said first clamping means further comprising a fixed shearing member disposed against said clamping plate, said shearing member having a free end which is remote from said connector supporting surface, an inwardly directed lip on said free end, said lip having one edge which extends parallel to said surface, said one edge functioning as a shearing edge for cooperation with a movable shearing edge to trim said conductors during movement thereof into said conductor-receiving portions of said terminals.

5. A fixture as set forth in claim 4, a conductor positioning plate against said clamping plate, said conductor locating means comprising aligned conductor-receiving slots in said conductor locating plate and said second clamping means.

6. A fixture as set forth in claim 5, said conductor positioning plate having a free end which extends beyond said lip on said shearing plate, a flange on said free end of said positioning plate which extends parallel to, and past said lip on said shearing plate, said slots being in said flange.

7. A fixture as set forth in claim 6, a conductor holding plate against said conductor positioning plate, said holding plate having conductor-receiving and retaining slots therein which are in alignment with said conductor-receiving slots in said conductor positioning plate and said second clamping means, said retaining slots having a width which is less than the thickness of said conductors whereby said conductors are retained in said retaining slots.

8. A fixture as set forth in either of claim 1 or 7, having removable connector-positioning means for selectively positioning said connector in said pocket, said positioning means comprising a pair of positioning blocks, said blocks being mounted in said pocket at spaced-apart locations on said supporting surface whereby said connector is selectively positioned in said pocket by placing said connector between said blocks.

9. A fixture as set forth in claim 8, said positioning blocks each having at least one recess on one side thereof, said recesses being dimensioned to receive said projections thereby to locate said blocks precisely in said pocket.

10. A fixture as set forth in claim 1, said channel-shaped frame member having flanges extending from said sidewalls for supporting said fixture on a harness board.

* * * * *